US007913641B2

(12) United States Patent
Dupertuis et al.

(10) Patent No.: US 7,913,641 B2
(45) Date of Patent: Mar. 29, 2011

(54) APPARATUS FOR COATING A CYLINDER IN PARTICULAR A WIPING CYLINDER OF AN INTAGLIO PRINTING PRESS

(75) Inventors: Didier Dupertuis, Goumoens-la-Ville (CH); Andrea Ganini, Mulazzano (IT)

(73) Assignee: KBA-Giori S.A., Lausanne (CH)

( * ) Notice: Subject to any disclaimer, the term of this patent is extended or adjusted under 35 U.S.C. 154(b) by 370 days.

(21) Appl. No.: 12/066,112

(22) PCT Filed: Sep. 11, 2006

(86) PCT No.: PCT/IB2006/053201

§ 371 (c)(1),
(2), (4) Date: May 9, 2008

(87) PCT Pub. No.: WO2007/031927

PCT Pub. Date: Mar. 22, 2007

(65) Prior Publication Data

US 2008/0216683 A1 Sep. 11, 2008

(30) Foreign Application Priority Data

Sep. 16, 2005 (EP) ..... 05108567

(51) Int. Cl.
*B05C 1/00* (2006.01)
*B05B 5/00* (2006.01)

(52) U.S. Cl. ..... 118/232; 118/258; 118/261; 118/58; 118/641; 118/642

(58) Field of Classification Search ..... 118/232, 118/258, 261, 262, 58, 60, 46, 212, 641–643, 118/DIG. 7; 427/372.2, 385.5, 393.5, 428; 34/269, 273; 101/157, 487, 155
See application file for complete search history.

(56) References Cited

U.S. PATENT DOCUMENTS 3,767,457 A 10/1973 Hubbard et al.

(Continued)

FOREIGN PATENT DOCUMENTS

EP 1 504 898 2/2005

(Continued)

OTHER PUBLICATIONS

International Search Report for PCT/IB2006/053201 mailed May 21, 2007.

(Continued)

*Primary Examiner* — Yewebdar T Tadesse
(74) *Attorney, Agent, or Firm* — Nixon & Vanderhye P.C.

(57) ABSTRACT

There is described an apparatus (1) for coating a cylinder (C), in particular a wiping cylinder of an intaglio printing press, with a plastic composition comprising, inter alia, heating means (6) for applying radiant heat to the cylinder throughout its length, the heating means being disposed in a movable hood part (7) adapted to be moved on top of the cylinder for applying heat thereto or away from the cylinder to allow mounting or dismounting of the cylinder (C) on or from the apparatus. In the closed state, the hood part forms an interior space enclosing the cylinder. The hood part includes a hood body (71) and a window panel (72, 73) mounted on a front side of said hood body to allow a human operator to monitor deposition of the plastic composition onto the surface of the cylinder. The hood body and window panel are constructed in such a manner that, when the hood part is moved on top of the cylinder, the window panel lies above the position where the coating unit (4) cooperates with the cylinder during coating.

16 Claims, 8 Drawing Sheets

U.S. PATENT DOCUMENTS

| | | | |
|---|---|---|---|
| 3,785,286 | A | 1/1974 | Giori |
| 3,900,595 | A | 8/1975 | Giori |
| 4,054,685 | A | 10/1977 | Giori |
| 4,339,472 | A | 7/1982 | Tachibana et al. |
| 4,702,946 | A | 10/1987 | Howland |
| 5,010,659 | A | 4/1991 | Treleven |
| 5,180,612 | A | 1/1993 | Rendell |
| 6,877,247 | B1 | 4/2005 | DeMoore |

FOREIGN PATENT DOCUMENTS

| | | |
|---|---|---|
| GB | 1 116 972 | 6/1968 |

OTHER PUBLICATIONS

Written Opinion for PCT/IB2006/053201 mailed May 21, 2007.
International Search Report for PCT/IB2006/053231 dated Mar. 30, 2007.
Office Action mailed Jul. 21, 2010 in U.S. Appl. No. 12/066,112.

APPARATUS FOR COATING A CYLINDER IN PARTICULAR A WIPING CYLINDER OF AN INTAGLIO PRINTING PRESS

This application is the U.S. national phase of International Application No. PCT/IB2006/053201 filed 11 Sep. 2006 which designated the U.S. and claims priority to European Patent Application No. 05108567.8 filed 16 Sep. 2005, the entire contents of each of which are hereby incorporated by reference.

TECHNICAL FIELD

The present invention generally relates to an apparatus for coating a cylinder, (particularly but not exclusively a wiping cylinder of an intaglio printing press) with a plastic composition.

BACKGROUND OF THE INVENTION

In intaglio printing presses, it is commonly known to use a wiping cylinder contacting the plate cylinder carrying the intaglio printing plate or plates as a wiping device for wiping and cleaning the surface of the intaglio printing plate or plates. The purpose of such a wiping cylinder is to simultaneously press the ink deposited onto the printing plates into the engravings and clean the excess ink from the plenum of the printing plates, i.e. the unengraved area of the printing plates outside the engravings.

In order to achieve good printing quality, the wiping cylinder is commonly designed in such a way that its outer surface contacting the printing plates is both physically and chemically resistant, i.e. is adapted to sustain the high contact pressure and friction with the printing plates and can withstand the physical and chemical contact with the ink components and pigments, as well as with the cleaning solutions which are used to clean the surface of the wiping cylinder.

It has already been proposed to provide such a wiping cylinder with an outer layer of resilient synthetic composition, namely a heat-hardenable plastic composition such as PVC. U.S. Pat. Nos. 3,785,286, 3,900,595 and 4,054,685 for instance disclose methods for making such wiping cylinders as well as apparatuses for implementing the said methods. These publications are incorporated by reference in the present application, especially in respect to the material used for forming such cylinders and to the machines and methods used for building such wiping cylinders. Referring for instance to the coating apparatus described in U.S. Pat. No. 4,054,685, means are provided for mounting a cylinder to be coated for horizontal rotation about its axis of rotation. Coating is performed by rotating the cylinder past a coating unit consisting of a straight-edged scraper blade mechanism disposed at one side of the cylinder and which extends parallel to the cylinder axis, this blade mechanism being adapted to be moved towards and away from the cylinder. The blade mechanism consists of two blades mechanically coupled to each other, namely a lower blade and an upper blade which are jointly designed to ensure a proper supply of heat-hardenable plastic material to the surface of the cylinder to be coated and allow adjustment of the thickness of the material to be deposited. The blade mechanism is adapted to be moved towards and away from the cylinder while maintaining the straight edge of the lower blade (i.e. the edge which extends along the length of the cylinder) parallel to the axis of rotation of the cylinder. The plastic material is supplied to the blade mechanism on top of the upper blade which is disposed, during coating of the cylinder, in an inclined relationship with respect to the cylinder so as to form a reservoir between the upper side of the upper blade and the periphery of the cylinder to be coated. Means are provided for restraining flow of the plastic material sideways from the reservoir. The blade mechanism can be translated towards and away from the cylinder in order to maintain a desired uniform spacing (a couple of millimeters or less) between the straight edge of the lower blade and the periphery of the cylinder along the full length of the cylinder. The cylinder is rotated in a direction to cause its periphery to move downwardly past the blade mechanism to thereby apply to the periphery of the cylinder a thin uniform layer of plastic composition having a thickness determined by the spacing between the straight edge of the lower blade and the periphery of the cylinder. This layer of plastic material is heat-cured by applying radiant heat to the cylinder throughout its length as the cylinder is rotated so as to cause hardening of the deposited layer of plastic material and produce a hardened layer of the desired hardness. Several layers with different hardnesses and thicknesses are preferably formed in this way onto the cylinder surface.

According to the solutions described in U.S. Pat. No. 4,054,685, the heating means for applying radiant heat to the cylinder are disposed in a movable hood part that can be displaced vertically on top of the cylinder. The hood part is designed in such a way that the cylinder is completely hidden below the hood part when the later is in place. Further not only is the cylinder completely hidden by the hood part, but also the coating unit. As a consequence, the coating process must be performed with the hood part moved up vertically so as to allow the user to supply the plastic composition on the coating unit and to visually monitor the coating process. It is only after the coating process has been performed that the hood part can be lowered onto the freshly coated cylinder to harden the deposited layer of plastic material. This prior art solution has a number of disadvantages including in particular a poor ability to aspirate the fumes generated during the coating process. Further, as heat has to be applied to the cylinder during the coating process, the operator is subjected to the heat generated by the heating means which has to be kept at a somewhat high level to compensate for the quick cooling effect caused by cool air flowing from all sides of the machine.

U.S. Pat. No. 5,180,612 discloses another type of apparatus for coating a wiping cylinder with a layer of plastic material which, in contrast to the previous apparatuses, makes use of a twin-roller coating unit for the application of the plastic material onto the surface of the cylinder. Rather than a vertically-moving hood part, there is provided a hood part that can be pivoted onto or away from the cylinder mounting location. A disadvantage of this solution however also resides in the fact that the operator cannot monitor the cylinder during the coating process, because the hood part completely hides the cylinder as well as the part of the coating unit which cooperates with the cylinder where the plastic composition is applied onto the cylinder. Further, the visibility of the cylinder is much more restricted with this solution due to the substantially greater size of the coating unit with its two application rollers. As a consequence, the operator must again open the hood part by an amount sufficient for him to be able to visually inspect the surface quality of the deposition, to the detriment of the efficiency of the aspiration of the fumes and of the heating.

Another disadvantage of the solution described in U.S. Pat. No. 5,180,612 resides in the structure of the heating means and aspiration system. Firstly, the heating means are disposed on a common reflector plate which constitutes an obstacle to the flow of air within the interior space of the hood part.

Secondly, the part of the aspiration system disposed on the machine is entirely located in the hood part, an exhaust pipe being coupled directly to the hood part. This construction can cause problems because the exhaust pipe (as well as the other pipe elements connected thereto) will be subjected to the same rotational movement as that of the hood part.

SUMMARY OF THE INVENTION

An aim of the invention is to improve the known devices and methods.

It is an aim of the present invention to provide an apparatus for coating a cylinder with a plastic composition of the type comprising a movable hood part which is of more adequate construction that the known apparatuses.

Another aim of the present invention is to provide a coating apparatus which allows simplification of the required operations to manipulate the apparatus. More precisely, one wishes to propose a solution which does require displacement of the hood part during the coating process.

Still another aim of the present invention is to provide a coating apparatus allowing the manufacture of cylinders exhibiting an increased coating quality.

Yet another aim of the present invention is to improve the operating conditions of the apparatus for the operator, especially with respect to the aspiration of the fumes generated during the coating and heating processes.

These aims are achieved thanks to the apparatus defined in the claims.

According to the invention, the hood part is constructed so as to include a hood body and a window panel mounted on a front side of the hood body to allow a human operator to monitor deposition of the plastic composition onto the surface of the cylinder during the coating process. The hood body and window panel are constructed in such a manner that, when the hood part is moved on top of the supporting means holding the cylinder, the window panel lies above the position where the coating unit cooperates with the cylinder during coating.

During coating of the cylinder, the hood part can thus be left in a closed state, the operator still having a good visibility of the cylinder thanks to the window panel. Keeping the hood part in place ensures an efficient aspiration of the fumes, improving as a consequence the operating conditions for the operator. In addition, as the hood part is kept in place during the whole coating process (which process typically includes a pre-heating phase of the cylinder to be coated, a coating phase per se, and a heat-curing phase) heat losses are limited, the heated air being confined within the interior space of the hood part. This permits a greater control of the heating profile and, as a consequence, leads to a better quality of the coating.

According to a preferred embodiment, the window panel is further adapted to be moved between a closed position, closed onto the hood body, and at least one open position (advantageously a plurality of open positions). This addition enables the operator to adjust his viewing angle of the cylinder depending on his location with respect to the machine. This provides even greater flexibility for the operator without substantially impairing the efficiency of the aspiration of the fumes.

According to still another preferred embodiment, the window panel itself incorporates a plurality of aspiration inlets distributed along an edge of the frame of the window panel to aspirate the fumes through an aspiration channel embedded within the frame of the window panel and which is coupled to the aspiration system. Preferably, these aspiration inlets are provided at least on a bottom edge of the frame of the window panel.

Other advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

EMBODIMENTS OF THE INVENTION

Figure 1:
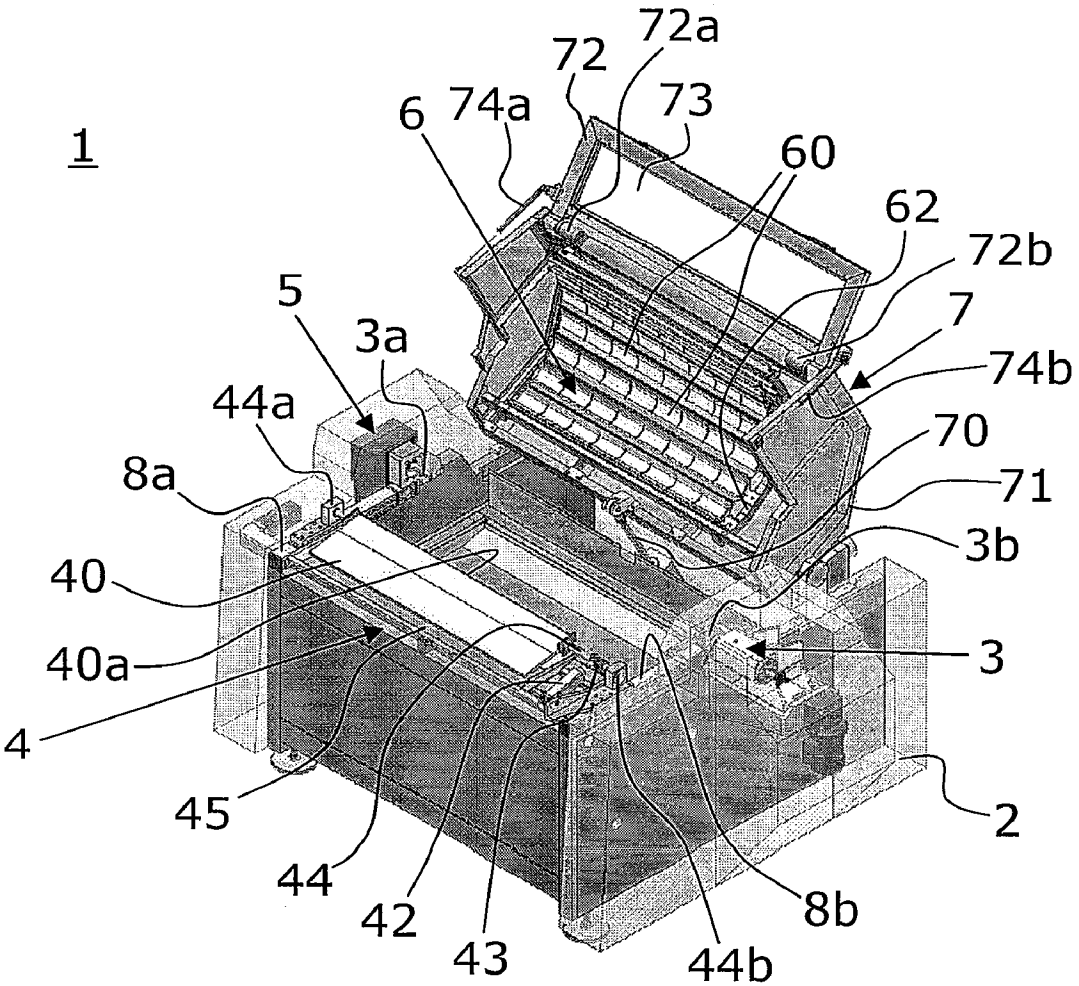
FIG. 1 is a perspective view of an embodiment of the coating apparatus showing the hood part in an open position.

FIG. 1 shows a perspective view of an embodiment of a coating apparatus according to the invention, designated globally by reference numeral 1. The coating apparatus 1 comprises a main machine body 2 which supports means 3 for horizontally mounting a cylinder to be coated (cylinder not shown in this Figure) for rotation about its axis of rotation, a coating unit 4 consisting, in this illustrative example, of a blade mechanism with a single blade 40 disposed on one side of the cylinder for the application of the heat-hardenable plastic composition (the blade mechanism is shown in FIG. 1 in a rest position which is pulled back away from the cylinder mounting location), driving means 5 (e.g. an electric motor or the like) for rotating the cylinder in a direction to cause its periphery to move past the coating unit 4, and heating means 6 for applying radiant heat to the cylinder throughout its length as the cylinder is rotated to cause hardening of the deposited layer of plastic composition.

Not shown is the centralized computer interface, known per se in the art, that is coupled to the functional parts of the machine and enables the operator to operate and interact with the machine. This computer interface preferably included a touch screen mounted on a pivotable supporting arm coupled at the frontal side of the machine body 2 (preferably on the right-hand corner of the frontal side of the machine 2) so that the operator can adjust and monitor the various parameters of the machine while facing the cylinder from the frontal part of the machine.

In this embodiment, the heating means 6 are located in a movable hood part 7 which can be pivoted onto or away from the cylinder location by an actuation mechanism 70 (such as a pneumatically-actuated arm coupled at one extremity to the main machine body 2 and at the other extremity to the hood part 7). The hood part 7 is advantageously provided with a hood body 71 and a window panel 72 comprising a window frame carrying a transparent heat-resistant glass window 73. In this example, the window panel 72 is preferably mounted rotatably at its upper part onto the hood body 71 by a pair of hinge members 72*a*, 72*b*, the window panel 72 being shown in an open position in FIG. 1. This window panel 72 enables the operator to have a clear view of the cylinder surface during both coating and heating of the cylinder when the hood part 7 is in its closed position (even when the panel 72 is closed onto the hood part 7). In the preferred embodiment as shown, the window panel 72 is further coupled to the hood body 71 by a pair of piston-like supporting members 74*a*, 74*b* enabling the window panel 72 to remain in any of a plurality of open positions.

The heating means 6 include a plurality of individual heating elements 60 (preferably ceramic heating elements shaped like tiles) mounted on a curved supporting frame 62 located inside the hood part 7. In this illustrative example, the heating elements 60 are arranged so as to form an array of eight columns of six heating elements each that are mounted on the curved supporting frame 62 so as to follow the curvature of the cylinder to be coated and extend along the full length of the cylinder.

Aspiration means, not shown in detail in this Figure, are further provided in the hood part 7 so as to suitably aspirate the fumes that are generated during the coating and heating processes. These fumes are preferably evacuated to an external condensation and/or filter unit (not shown) before disposal.

The means 3 for mounting the cylinder to be coated for horizontal rotation about its axis of rotation include a pair of bearings 3*a*, 3*b* that resemble the head-stock and tail-stock, respectively, of a lathe. The head-stock 3*a* holds a revolving spindle driven by the driving means 5 for coupling with one extremity of the cylinder to be coated and for driving the cylinder into rotation. The tail-stock 3*b* can be moved axially along the axis of rotation of the cylinder to be coated to be secured to the other extremity of the cylinder and to accommodate different lengths of cylinder. If necessary, shaft extensions can be secured to one or both of the head-stock 3*a* and tail-stock 3*b* in order to mount short cylinders.

As mentioned hereinabove, the coating unit 4 is shown in FIG. 1 in a rest position (or cleaning position). The blade 40 is mounted on the coating unit 4 so as to be able to rotate about a rotation axis which is substantially parallel to the axis of rotation of the cylinder to be coated. More precisely, in the rest position, the blade 40 is rotated in such a manner that waste material from the coating process can be cleaned away from the blade into a collecting receptacle 45 disposed underneath the blade 40 (in this example the blade 40 is rotated in such a way that its upper side is oriented towards an operator which would face the frontal part of the machine). This collecting receptacle 45 is advantageously secured to the coating unit 4 so as to follow its movement toward and away from the cylinder to be coated. The collecting receptacle could alternatively be fixedly secured to the machine body 2.

The coating unit 4 is adapted to be moved towards and away from the cylinder to be coated. To this end, the coating unit 4 is coupled to translation means comprising a pair of guide members 8*a*, 8*b* located on each side of the coating unit 4. Translation of the coating unit 4 onto the guide members 8*a*, 8*b* is induced by suitable driving means, preferably electrical motors. The translation means ensure appropriate displacement of the coating unit 4 between the cleaning position, shown in FIG. 1, and the operating position (or coating position), shown in FIG. 2, as well as micrometric retraction of the coating unit 4 away from the surface of the cylinder during the coating operation.

Figure 2:
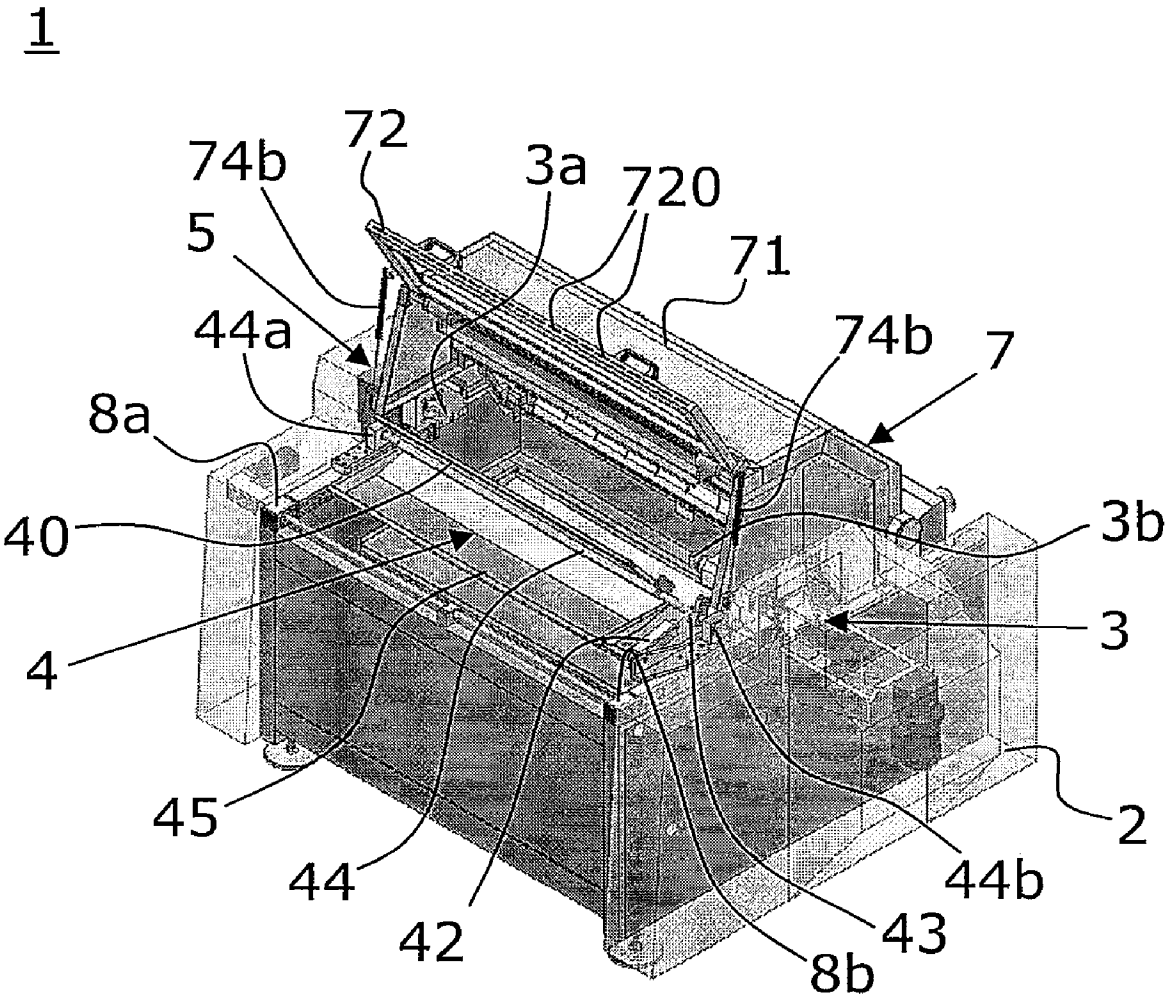
FIG. 2 is a perspective view of the coating apparatus of FIG. 1 showing the hood part in a closed position.

FIG. 2 is a perspective view of the embodiment of FIG. 1 showing the hood part 7 in its closed position (the window panel 72 being still shown in an open state) and the coating unit 4 in its coating position. FIG. 2 also shows the tail-stock 3*b* moved axially towards the head-stock 3*a* as this would be the case after having mounted a cylinder to be coated between the head-stock 3*a* and tail-stock 3*b* (no cylinder being again shown in FIG. 2 for the purpose of simplification).

FIG. 2 further shows that the blade 40 of the coating unit 4 is rotated towards the cylinder to be coated, the straight edge 40*a* of the blade 40 (see FIG. 1) being directed towards the periphery of the cylinder. More precisely, the blade 40 is disposed, during coating of the cylinder, in an inclined relationship with respect to the cylinder so as to form a reservoir between the upper side of the blade 40 and the periphery of the cylinder for receiving a supply of heat-hardenable plastic composition.

Rotation of the blade 40 between the cleaning position shown in FIG. 1 and the coating position shown in FIG. 2 is advantageously performed by means of an actuator 42 (such as a pneumatic piston) actuating a rotating arm 43 coupled to the underside of the blade 40 via a shaft member 44 (the shaft member 44 being mounted between two bearings 44*a*, 44*b* supported at each side of the coating unit 4 on the guide members 8*a*, 8*b*). The means 42, 43, 44 for causing rotation of the blade 40 form means for discontinuing the application of the plastic composition at the end of the coating process.

Figure 3A:
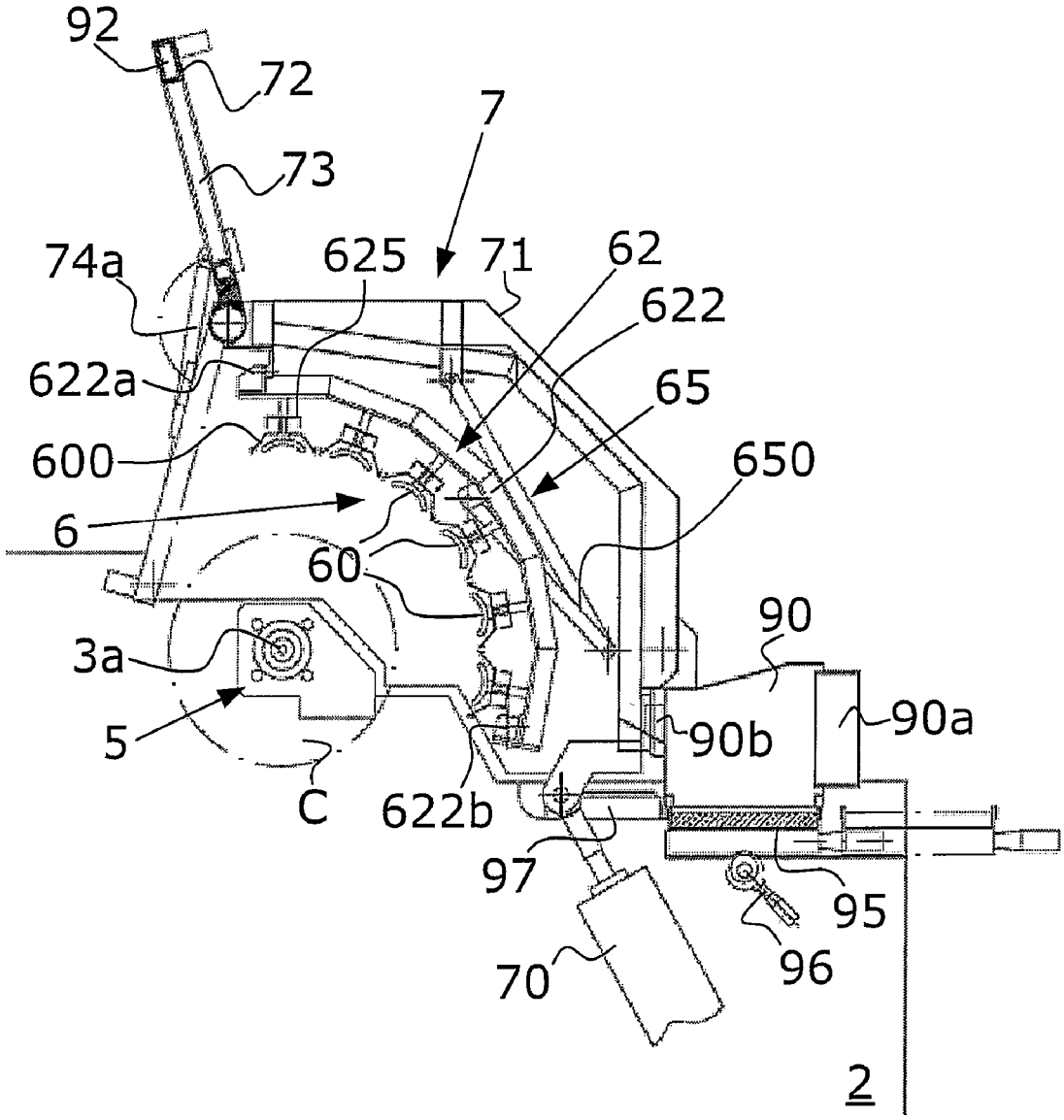
FIG. 3*a* is a side view of the coating apparatus of FIG. 2 taken perpendicularly to the axis of rotation of the cylinder to be coated.

FIG. 3*a* is a side view of the coating apparatus taken perpendicularly to the axis of rotation of the cylinder to be coated (which cylinder is indicated in dash-dotted lines and designated by reference C). This Figure shows in greater detail the inner space of the hood part 7 (with the window panel 72 in an open state) and the disposition of the heating means 6 within the hood part 7. The side view is taken from the right-hand side of the apparatus and shows in particular the head-stock 3*a* of the supporting means 3 with the driving means 5, the curved supporting frame 62 supporting the heating elements 60 and the actuation mechanism 70 for opening or closing the hood part 7.

The coating unit 4 is not shown in FIG. 3*a* (nor in FIGS. 3*b* to 7) but it will be understood that, during coating of the cylinder C, the coating unit 4 would be displaced forward as shown in FIG. 2 to be brought close to the peripheral surface of the cylinder C. In the closed state of the hood part 7, as shown in FIG. 3*a*, the window panel 72 lies above the position where the coating unit 4 cooperates with the cylinder C during coating when the window panel is completely closed or slightly open. As this will be appreciated hereinafter, the window panel 72 is preferably provided with integrated aspiration means for aspirating air and fumes from a bottom part of the window panel 72, thereby efficiently aspirating any fumes or vapours coming out of the coated cylinder or of the plastic composition supplied to the coating unit 4.

In FIG. 3*a*, one may already notice that the supporting frame 62 carrying the heating elements 60 is advantageously coupled to the hood part by means of an articulated mechanism 65. As this will be seen hereinafter with reference to FIG. 7, this articulated mechanism 65 is used to facilitate maintenance operations, especially replacement of defective heating elements. As already mentioned, the heating elements 60 are arranged in the form of a matrix (six rows of eight elements each in this illustrative example). The heating elements 60 are advantageously supported onto the supporting frame 62 so as to facilitate the flow of air through the heating means 6, in-between the heating elements 60. In this preferred example, the supporting frame 62 comprises a pair of curved members 622 disposed on the left-hand side and right-hand side of the matrix of heating elements 60. These curved members 622 are each coupled approximately at a mid-position to one extremity of a twin-arm articulation 650 fixedly secured by its other extremity to the hood part 7. As this will be seen hereinafter, each curved member 622 is fixed at its two ends 622*a*, 622*b* to the hood part 7, the upper front fixation 622*a*, near the window panel 72, being releasable, while the bottom rear fixation 622*b* is designed in such a way as to allow the curved members 622 to rotate relatively to the hood part 7 upon release of the front fixation 622*a*.

The pair of curved members 622 support in turn eight supporting rails 625 by their ends, each supporting rail 625 carrying a corresponding one of the rows of heating elements 60. Preferably, each row of heating elements 60 shares a common reflector 600 which is supported by the corresponding supporting rail 625. The function of these reflectors 600 is to orient the radiant heat produced by each row of heating elements 60 towards the cylinder C and help to prevent excessive heating of the top-rear end of the hood part 7. As this is schematically illustrated in FIG. 5, the preferred configuration of the heating means 6 allows air to flow in-between each row of heating elements, favouring a better flow of air within the hood part 7 and, as a consequence, an improved aspiration efficiency.

Also shown in FIG. 3*a* is an aspiration chamber 90 forming part of the aspiration system of the machine which is fixedly secured to the machine frame 2. Fumes which are aspirated out of the interior space of the hood part 7 are evacuated through this aspiration chamber 90, at least one outlet 90*a* at the rear end of the chamber 90 being provided for coupling to an external aspiration unit (not shown). At the front side of the chamber 90 there is provided at least one coupling section 90*b* for coupling with at least one corresponding aspiration conduit (see conduits 93 and 94 in FIGS. 5 and 6) provided within the hood part 7. Thanks to this configuration, external pipes are connected to a part of the machine that does not move, the aspiration system consisting of two parts that are operatively coupled to each other upon closure of the hood part 7.

Figure 4:
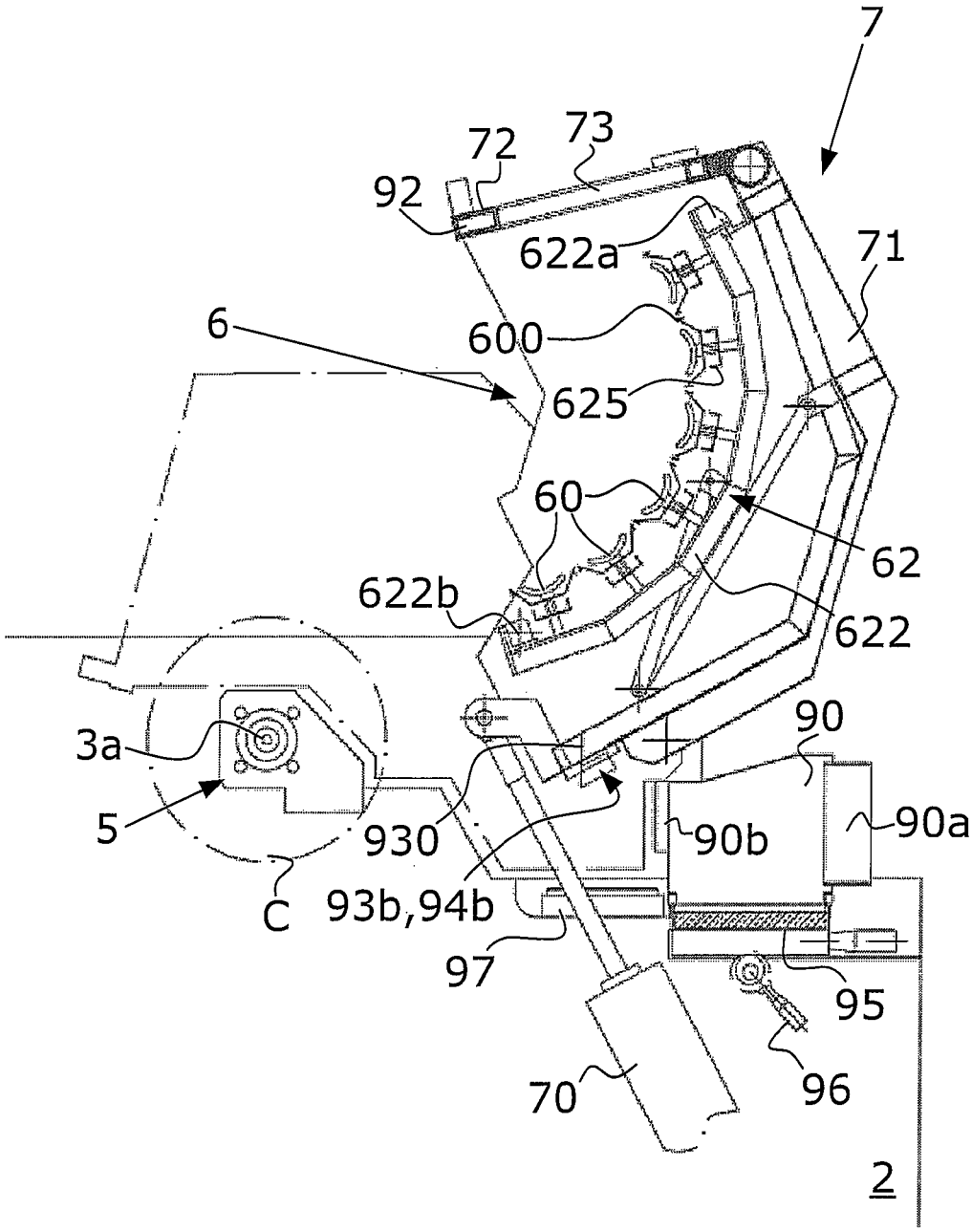
FIG. 4 is a side view of the coating apparatus taken perpendicularly to the axis of rotation of the cylinder to be coated showing the hood part in an open position, window panel closed onto the hood part.
Figure 5:
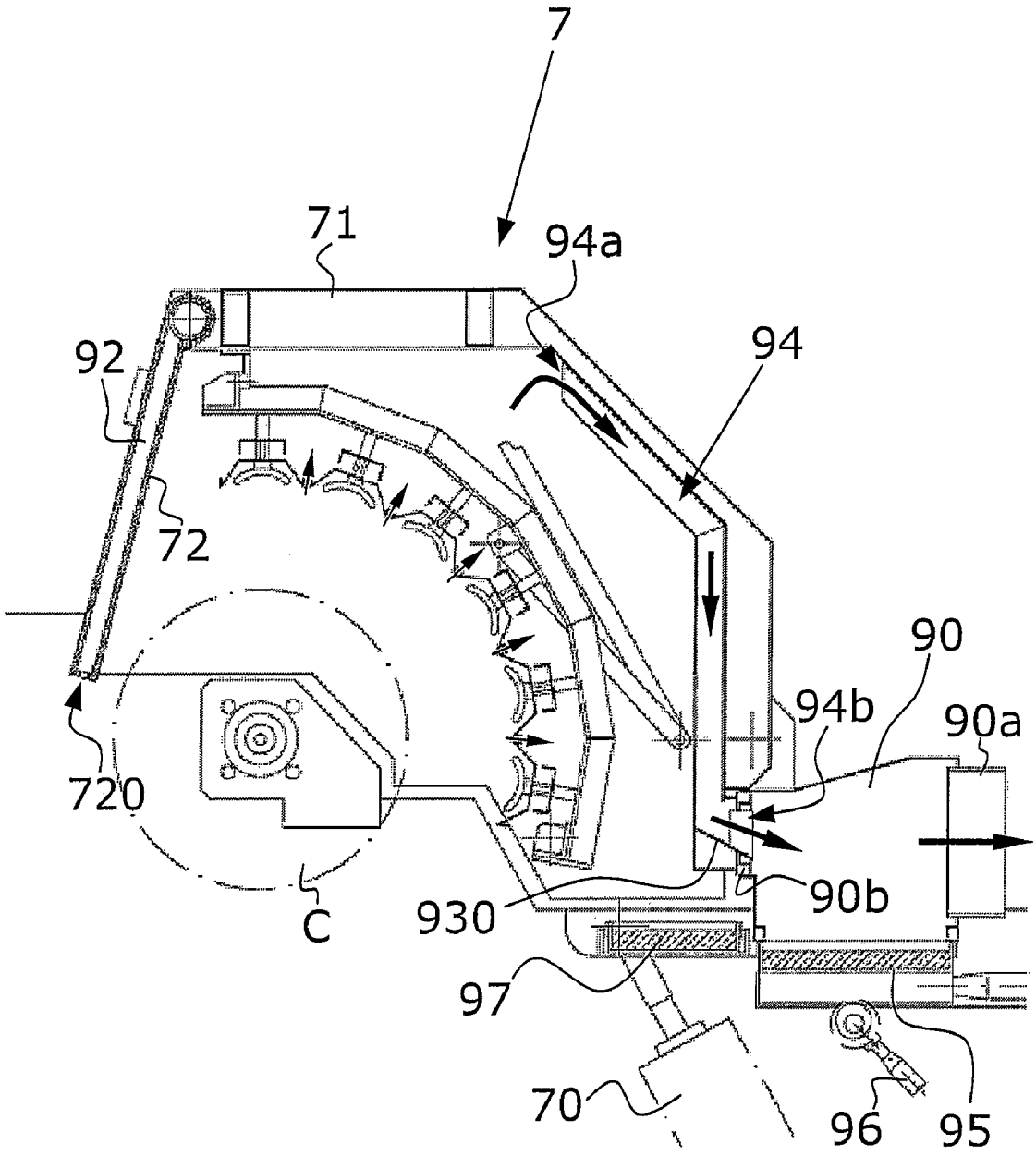
FIG. 5 is a side view of the coating apparatus taken perpendicularly to the axis of rotation of the cylinder to be coated showing in greater detail the part of the aspiration system preferably used to aspirate the fumes from the interior space of the hood part.

In the preferred embodiment, the hood part 7 includes a pair of aspiration conduits 93 disposed at the left-hand side and right-hand side of the hood body 71 (see FIG. 6) which are coupled at one end to the window panel 72 (through the hinge members 72*a*, 72*b*) and a main aspiration conduit 94 which opens into the hood part 7 (see FIG. 5). The aspiration conduits 93, 94 are preferably distinct from each other and do not communicate directly. More precisely, each aspiration conduit 93, 94 leads to a corresponding coupling section 93*b*, 94*b* (not shown in FIG. 3*a*) at the bottom-rear end part of the hood body 71 for coupling to the coupling section 90*b* of the aspiration chamber 90 (see FIGS. 4, 5 and 6). Preferably, the chamber 90 is subdivided into three parts, two lateral parts for coupling with the pair of conduits 93 and a central part for coupling with the main aspiration conduit 94.

A removable receptacle 95 is provided at the bottom side of the chamber 90. The purpose of this receptacle is to collect waste fluid resulting from the condensation of the aspirated fumes which occurs within the aspiration conduits of the hood part 7. In use, this receptacle 95 is coupled in a sealed manner to the chamber 90 (under the action of an eccentric actuation mechanism 96 which cooperates with the bottom side of the receptacle 95). Upon release of the actuation mechanism 96, the receptacle 95 can be removed from the rear side of the apparatus for cleaning, as schematically illustrated in FIG. 3*a*. Absorbing material (such as a sponge like member) can advantageously be placed in the receptacle 95 in order to absorb the waste fluid and facilitate disposal thereof.

Figure 3B:
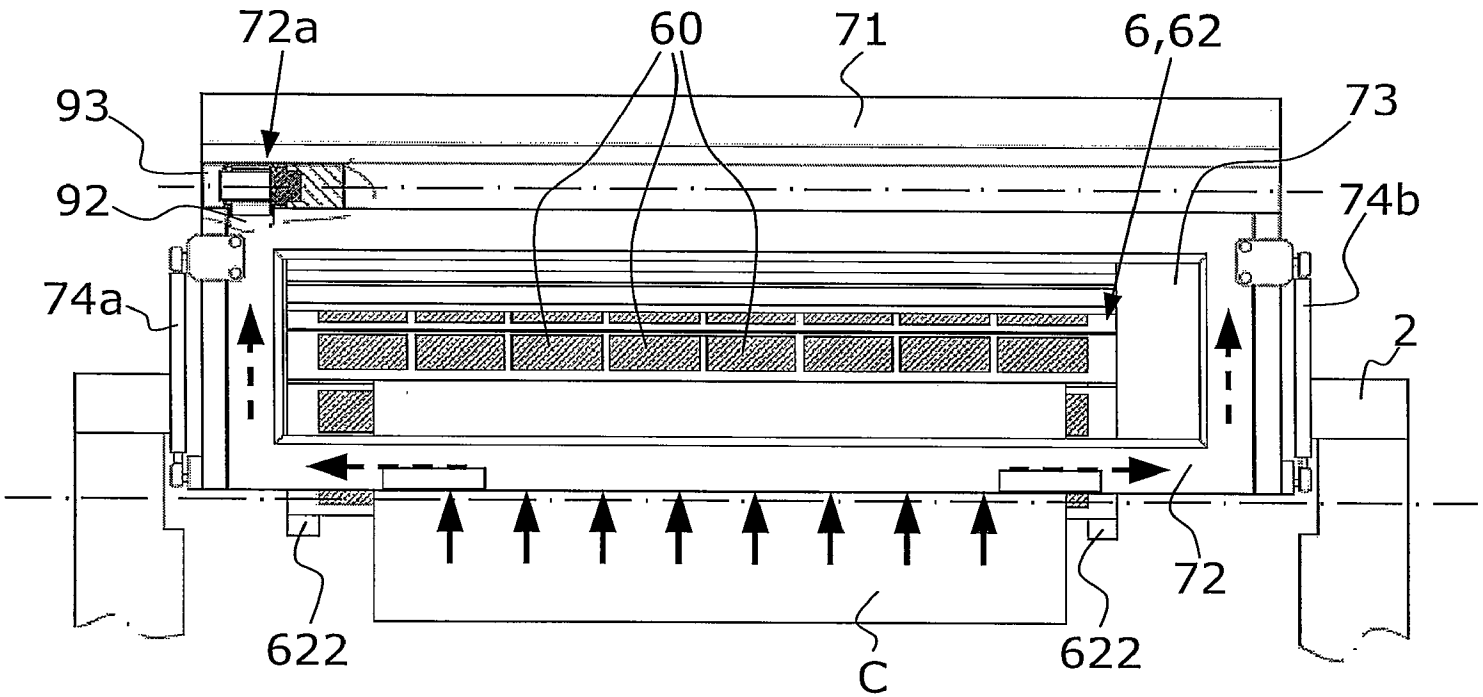
FIG. 3*b* is a front view of the coating apparatus of FIG. 3*a* taken perpendicularly to the window panel (when closed onto the hood part)

FIG. 3*b* is a schematic front view of the apparatus of FIG. 3*a* taken approximately perpendicularly to the window panel 72 (in the closed position), while FIG. 4 is a side view of the coating apparatus 1 showing the hood part 7 in an open state, pivoted backwards by the actuation mechanism 70. The elements already mentioned hereinabove in connection with FIGS. 1, 2 and 3*a* are again designated by their corresponding reference numerals.

In FIG. 4, one can see the aspiration chamber 90 being decoupled from the aspiration conduits 93, 94 of the hood part 7. In this open state, the coupling sections 93*b*, 94*b* of the aspiration conduits are decoupled from the coupling section 90*b* of the aspiration chamber 90, the waste fluid resulting from condensation being able to drop under the effect of gravity at the bottom rear end part of the machine. A pair of receptacles 97 located on the left-hand and right-hand sides are therefore provided below the coupling sections 93*b*, 94*b* in order to receive the waste fluid flowing out of the aspiration conduits 93, 94. Preferably, the extremity of each aspiration conduit 93, 94 at the coupling section 93*b*, 94*b* is shaped so as to facilitate the flow of the waste fluid, both in the state where the hood part 7 is opened and in the state where the hood part 7 is closed. To this end, the coupling section 93*b*, 94*b* of each conduit 93, 94 is shaped so as to exhibit an inclined guiding surface 930 as illustrated.

Figure 6:
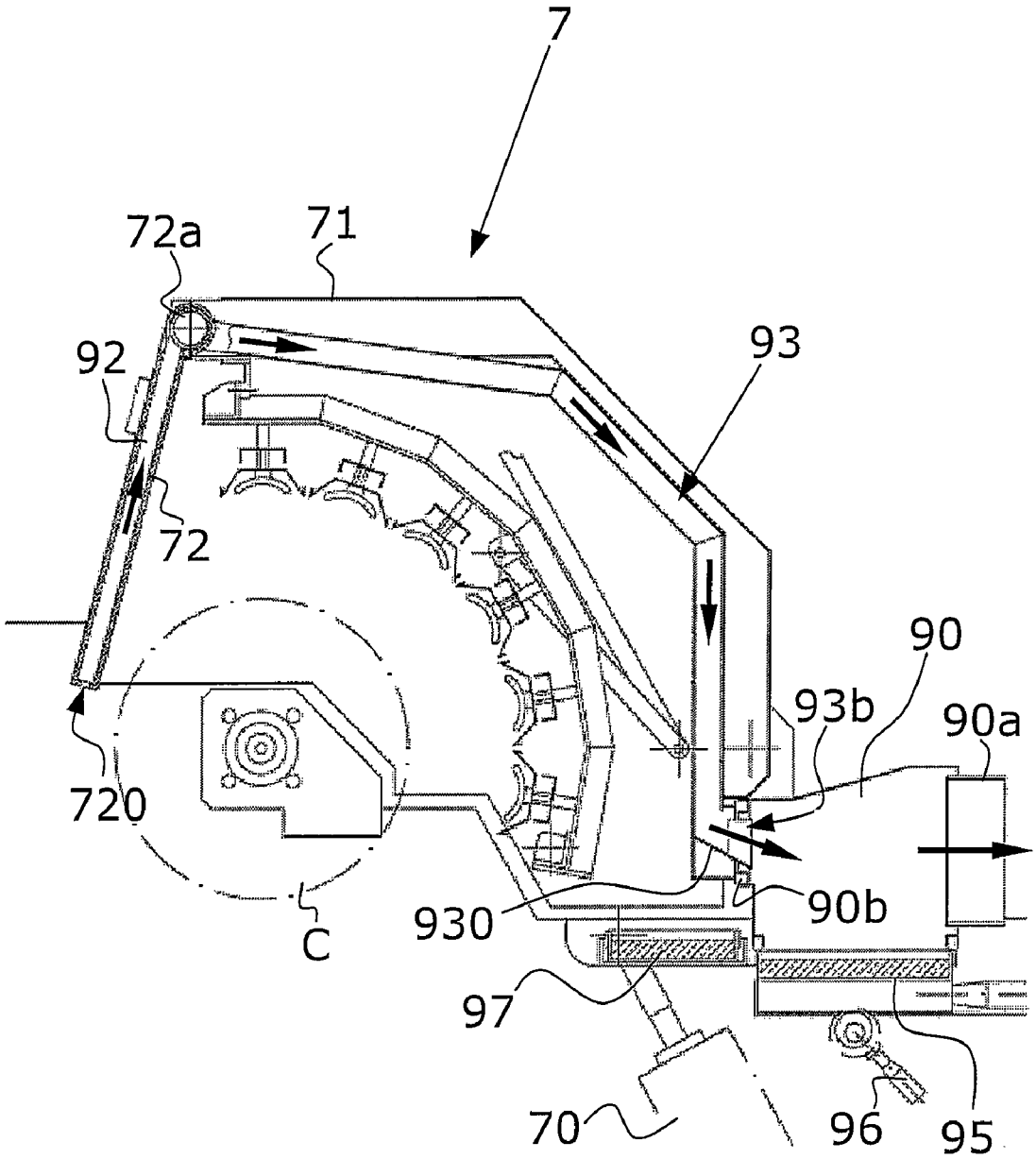
FIG. 6 is a side view of the coating apparatus taken perpendicularly to the axis of rotation of the cylinder to be coated showing in greater detail the part of the aspiration system preferably used to aspirate the fumes from within the window panel.

With reference to FIGS. 5 and 6, one will now describe in greater detail the configuration of the aspiration conduits 93, 94 located within the hood part 7 according to the preferred embodiment. FIG. 5 shows in particular the configuration of the main aspiration conduit 94 for aspirating the fumes out of the interior space of the hood part 7 while FIG. 6 shows the configuration of the aspiration conduit 93 located on the left-hand side of the hood part 7 (the aspiration conduit 93 on the right-hand side being the mirrored image of the one illustrated in FIG. 6).

As shown in FIG. 5, the main aspiration conduit 94 opens at an upper part of the hood part 7. The aspiration inlet 94*a* of the main conduit 94 preferably extends along the length of the hood part 7 (parallel to the axis of rotation of the cylinder C). In this example, the lower part of the aspiration conduit 94 is divided into two portions (this subdivision being not illustrated) which communicate with the same aspiration inlet 94*a*. These portions extend to the bottom-rear of the hood part 7 at the left-hand side and right-hand side and open as two separate coupling sections 94*b* for coupling with the aspiration chamber 90.

As shown in FIG. 6, the window panel 72 is provided with a number of aspiration inlets 720 distributed along an edge (preferably the bottom edge) of the window frame in order to aspirate the fumes. These aspiration inlets 720 also appear on the illustration of FIG. 2. The aspiration inlets 720 communicate with an aspiration channel 92 provided inside the frame of the window panel 72. This channel 92 is coupled at each side of the window panel 72 to the corresponding one of the two aspiration conduits 93. Coupling is realized by providing each hinge member 72*a*, 72*b* with a hollow portion communicating on the one hand with the aspiration conduit 93 and on the other hand with the aspiration channel 92 as illustrated in FIG. 3*b*. In a closed state, air and fumes can be aspirated through the aspiration inlets 720, via the aspiration channel 92, the hinge members 72*a*, 72*b* and the aspiration conduits 93 as schematically illustrated by the arrows in FIGS. 3*b* and 6 in order to be then evacuated through the aspiration chamber 90. Advantageously, the hinge members 72*a*, 72*b* are configured in such a way as to ensure a communication between the aspiration channel 92 and the aspiration conduits 93 over a certain angular displacement of the window panel 72 and to close the communication between the aspiration channel 92 and the aspiration conduits 93 when the window panel 72 is opened to a greater extent. This can be achieved by suitably designing the hollow portion of the hinge members 72*a*, 72*b* so that it exhibits an opening communicating with the aspiration channel 92 over a limited rotation angle.

Figure 7:
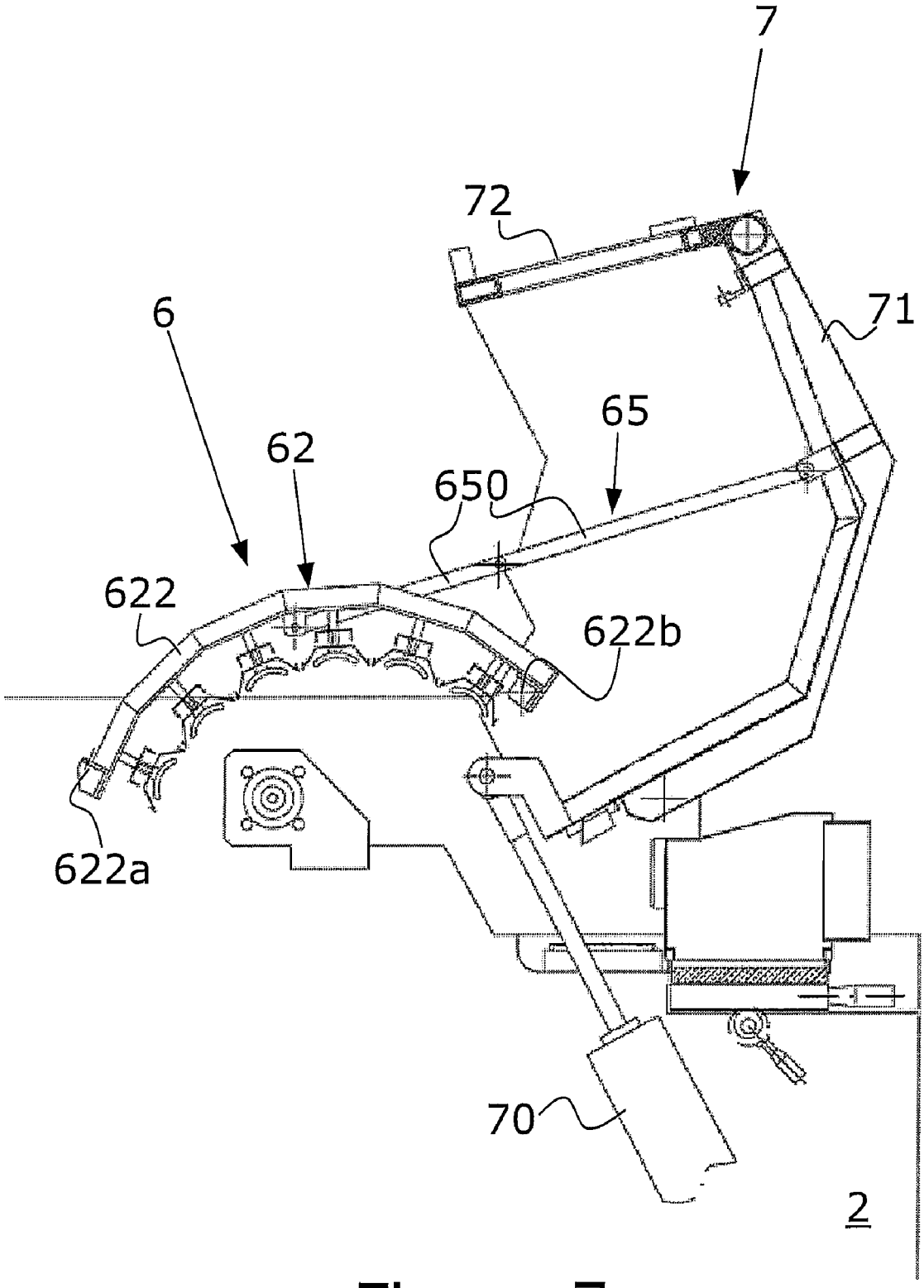
FIG. 7 is a side view of the coating apparatus showing a preferred way of mounting the heating elements in the hood part so as to facilitate maintenance operations.

Turning now to FIG. 7, one will briefly describe the articulated mechanism 65 used in the preferred embodiment to couple the supporting frame 62 to the interior of the hood part 7. As mentioned hereinabove, the supporting frame 62, or more precisely the front fixation 622*a* (which fixation can be any sort of releasable mechanical fixation means such as a screw member) of each supporting member 622, can be disconnected from the hood part 7. Even after disconnection of the front fixation 622*a*, the supporting frame 62 remains coupled to the hood part 7 through the articulated mechanism 65 and through the bottom rear fixation 622*b* of each supporting member 622. Upon disconnection of the front fixation 622*a*, the supporting frame 62 is however capable of rotating with respect to the hood part 7 about an axis of rotation defined by the bottom rear fixation 622*b* as illustrated in FIG. 7.

Disconnection of the support frame 62 for maintenance purposes would occur as follows. Starting with the hood part 7 in a closed stated (as shown in FIG. 3*a*), the front fixation 622*a* of each supporting member 622 is disconnected so as to release the front part of the support frame 62 from the hood part 7. Under the effect of its own weight the supporting frame 62 is free to rotate (in a counter clockwise direction in FIG. 7). While the supporting frame 62 is held by an operator, the hood part 7 is driven to its open state as illustrated in FIG. 7, the actuation mechanism 70 pushing the hood part 7 so that it rotates backwards. In the process, the pair or twin-arm articulations 650 unfold and straighten. In the open state, both twin-arm articulations 650 are completely unfolded and hold back the supporting frame 62 suspended in the air. The operator can now access the rear end of the supporting frame 62, where the electrical connections of the heating elements 60 are located. One will understand that this specific supporting arrangement greatly facilitates maintenance operations, especially replacement of any defective heating element.

The Figures shows that each row of heating elements 60 is disposed at equal distance with respect to the cylinder surface, i.e. the heating means 6 lies concentrically with the axis of rotation of the cylinder C. It may alternatively be advantageous to dispose some rows of heating elements closer to the cylinder surface that other rows. More particularly, it may be advantageous to dispose the first rows of heating elements which are proximate to the window panel 72 so that their distance with respect to the cylinder is smaller than the rows of heating elements 60 lying further back in the hood part 7. This would have the advantage of increasing the heating efficiency in the vicinity of the front area of the hood part 7 where the window panel is located 72 so as to compensate for temperature differences within the interior space of the hood part 7 as well as temperature losses occurring when opening the window panel 72. This solution could also improve the flow of air and increase the efficiency of the aspiration of the fumes.

It will be understood that various modifications and/or improvements obvious to the person skilled in the art can be made to the embodiments described hereinabove without departing from the scope of the invention defined by the annexed claims. For instance, the hood part 7 could perfectly be mounted so as to be moved by other means than by pivoting, such as by translating the hood part. A pivotable mounting however remains the preferred solution due to its relative simplicity. Similarly, other means than a pneumatically-actuated piston could be used in order to perform opening and closing of the hood part.

It will also be appreciated that various modifications and/or improvements could be made to the aspiration system without departing from the scope of the invention. For instance, while the preferred embodiment provides for a separation between the aspiration conduits for the window panel and for the hood part, it could be envisaged to provide a common aspiration conduit. The proposed solution is however preferred as it enables to completely decouple the two parts of the aspiration system and adjust the power or flow of the aspiration separately for each part, a greater aspiration force being comparatively necessary for the hood part than for the window panel.

The invention claimed is:

1. An apparatus for coating a cylinder with a plastic composition comprising:

supporting means for horizontally mounting a cylinder for rotation about its axis of rotation;

a coating unit disposed on one side of the cylinder for selectively applying a layer of heat-hardenable plastic composition onto the surface of the cylinder;

driving means for rotating the cylinder in a direction to cause its peripheral surface to move past said coating unit;

heating means for applying radiant heat to said cylinder throughout its length as said cylinder is rotated, said heating means being disposed in a movable hood part adapted to be moved on top of the cylinder for applying heat thereto or away from the cylinder to allow mounting or dismounting of the cylinder on or from the supporting means, said movable hood part forming, when moved on top of supporting means, an interior space enclosing the cylinder; and an aspiration system with aspiration inlets provided on said movable hood part for aspirating fumes out of the interior space of the movable hood part, wherein said movable hood part includes a hood body and a window panel mounted on a front side of said hood body to allow a human operator to monitor deposition of the plastic composition onto the surface of the cylinder, said hood body and window panel being constructed in such a manner that, when the movable hood part is moved on top of the cylinder, the window panel lies above the position where the coating unit cooperates with the cylinder during coating.

2. The apparatus according to claim 1, wherein said window panel is movable between a closed position, closed onto the hood body, and at least one open position.

3. The apparatus according to claim 2, wherein said window panel is movable between a plurality of open positions.

4. The apparatus according to claim 1, wherein said window panel includes a window frame within which is mounted a glass window and wherein said window panel includes a plurality of aspiration inlets distributed along an edge, preferably the bottom edge, of said window frame to aspirate the fumes, said plurality of aspiration inlets being coupled to the aspiration system through an aspiration channel provided within said window frame.

5. The apparatus according to claim 4, wherein said window panel is mounted onto said hood body so as to pivot about a rotation axis defined by a pair of hinge members and wherein said hinge members each include a hollow portion communicating, on the one hand, with the aspiration channel provided within the window panel and, on the other hand, at least one first aspiration conduit provided within the hood body.

6. The apparatus according to claim 5, wherein each hinge member communicates with a separate aspiration conduit located in the hood body.

7. The apparatus according to claim 5, wherein said aspiration system includes a main aspiration conduit opening into said movable hood part, said main aspiration conduit being separate from the said at least first aspiration conduit.

8. The apparatus according to claim 1, wherein said aspiration system includes an aspiration chamber fixedly secured to a machine frame of the apparatus which comprises at least one outlet for coupling to an external aspiration unit, and at least one coupling section for coupling with at least one corresponding aspiration conduit provided within the hood body.

9. The apparatus according to claim 8, wherein said aspiration chamber includes a removable receptacle for collecting waste fluid resulting from condensation of said fumes in said aspiration conduit.

10. The apparatus according to claim 8, further comprising at least one receptacle for collecting waste fluid resulting from condensation of said fumes in said aspiration conduit, said at least one receptacle being located in such a manner as to receive the waste fluid flowing out of the aspiration conduit when the movable hood part is in an open state.

11. The apparatus according to claim 1, wherein said heating means comprise a plurality of discrete heating elements distributed along the length of the cylinder and around at least part of the peripheral surface of the cylinder, said heating means being designed in such a manner as to allow fumes to be aspirated through the heating means, between the plurality of discrete heating elements.

12. The apparatus according to claim 11, wherein said plurality of discrete heating elements are arranged in rows and columns, each row of said plurality of discrete heating elements being disposed on a corresponding supporting rail, fumes being able to be aspirated between each of said supporting rails.

13. The apparatus according to claim 12, wherein each supporting rail supports a reflector carrying a corresponding row of said plurality of discrete heating elements for orienting the radiant heat produced by said plurality of discrete heating elements towards the cylinder.

14. The apparatus according to claim 1, wherein said heating means are disposed on a supporting frame mounted inside the movable hood part, said supporting frame being coupled to the hood part by means of a releasable articulated mechanism.

15. The apparatus according to claim 1, wherein said movable hood part is mounted so as to be pivotable about a rotation axis parallel to the axis of rotation of the cylinder.

16. The apparatus according to claim 1, wherein the cylinder is a wiping cylinder of an intaglio printing press.

* * * * *